US007045461B2

(12) United States Patent
Imori et al.

(10) Patent No.: US 7,045,461 B2
(45) Date of Patent: May 16, 2006

(54) METAL PLATING METHOD, PRETREATMENT AGENT, AND SEMICONDUCTOR WAFER AND SEMICONDUCTOR DEVICE OBTAINED USING THESE

(75) Inventors: Toru Imori, Kitaibaraki (JP); Masashi Kumagai, Hitachi (JP); Junnosuke Sekiguchi, Kitaibaraki (JP)

(73) Assignee: Nikkon Materials Co., Ltd., Tokyo (JP)

( * ) Notice: Subject to any disclaimer, the term of this patent is extended or adjusted under 35 U.S.C. 154(b) by 51 days.

(21) Appl. No.: 10/767,697

(22) Filed: Jan. 29, 2004

(65) Prior Publication Data

US 2004/0182714 A1 Sep. 23, 2004

Related U.S. Application Data

(63) Continuation-in-part of application No. 10/169,778, filed as application No. PCT/JP00/08166 on Nov. 20, 2000, now abandoned.

(30) Foreign Application Priority Data

Jan. 7, 2000 (JP) ..... 2000-1645
Aug. 7, 2000 (JP) ..... 2000-238047

(51) Int. Cl.
*H01L 21/44* (2006.01)

(52) U.S. Cl. ..... 438/678; 438/687; 438/654; 427/301; 427/304

(58) Field of Classification Search ..... 438/678, 438/687, 654; 427/301, 304
See application file for complete search history.

(56) References Cited

U.S. PATENT DOCUMENTS 4,986,848 A * 1/1991 Yamamoto et al. ..... 106/1.11
5,258,522 A * 11/1993 Tsuchida et al. ..... 548/110
6,197,688 B1 * 3/2001 Simpson ..... 438/678
2002/0192379 A1 * 12/2002 Imori ..... 427/304

FOREIGN PATENT DOCUMENTS

| | | |
|---|---|---|
| GB | 2 324 538 | 10/1998 |
| JP | 59-52701 | 12/1984 |
| JP | 60-181294 | 9/1985 |
| JP | 61-194183 | 8/1986 |
| JP | 63-227784 | 9/1988 |
| JP | 63-270474 | 11/1988 |
| JP | 1-117089 | 5/1989 |
| JP | 3-44149 | 7/1991 |
| JP | 6-256358 | 9/1994 |
| JP | 11-92482 | 4/1999 |
| JP | 11-288940 | 10/1999 |

* cited by examiner

*Primary Examiner*—Amir Zarabian
*Assistant Examiner*—Christy Novacek
(74) *Attorney, Agent, or Firm*—Flynn, Thiel, Boutell & Tanis, P.C.

(57) ABSTRACT

Resin cloths, powders, specular bodies and other objects resistant to conventional plating can be plated with metals by a simple method.

According to the metal plating method of the present invention, electroless plating is performed after the surface of a object to be plated is treated with a pretreatment agent obtained by reacting or mixing in advance a noble metal compound (catalyst) with a silane-coupling agent having functional groups capable of capturing metals. According to this method, metal plating can be securely applied to powders, resin cloths, semiconductor wafers, and other specular bodies. Moreover, the problem of the insufficient coverage of the seed layer on the inside walls of vias and trenches during the formation of fine wiring can be addressed by applying this method to semiconductor wafers. The silane-coupling agent may be a compound containing azole groups, preferably an imidazole.

11 Claims, 1 Drawing Sheet

METAL PLATING METHOD, PRETREATMENT AGENT, AND SEMICONDUCTOR WAFER AND SEMICONDUCTOR DEVICE OBTAINED USING THESE

CROSS REFERENCE TO RELATED APPLICATION

This is a continuation in part of Ser. No. 10/169 778, filed Jul. 2, 2002 now abandoned, which was the national stage of International Application No. PCT/JP00/08166, filed Nov. 20, 2000, which International Application published in English.

BACKGROUND OF THE INVENTION

1. Field of the Invention

The present invention relates to a method in which electroless plating is used for plating metals onto the surface of a material, specular body, powder, or other object having low electrical conductivity. The present invention also relates to an electroless plating method for forming copper wiring on a semiconductor wafer, and more particularly to an electroless plating method suitable for semiconductor wafers in which minute vias or trenches can be embedded without forming voids, seams, or other defects.

2. Description of the Related Art

Electroless plating, which is a method for forming metal films on a substrate devoid of electrical conductivity, is employed when, for example, printed wirings are formed on resin substrates. Common processes entail performing so-called activation, which is a process whereby palladium or another noble metal is deposited in advance as a catalyst on the substrate as part of an electroless plating pretreatment. Conventionally used methods include those in which the substrate is first treated with a hydrochloric aqueous solution of $SnCl_2$ and is then immersed in an aqueous solution of $PdCl_2$ to adsorb Pd; and those in which Pd is deposited on the surface with the use of a colloid solution containing Sn and Pd. These methods have numerous disadvantages, such as the use of highly toxic Sn and the complexity of the treatment processes. In view of this, methods based on the use of silane-coupling agents having the functional groups that form complexes with Pd and other noble metals have recently been proposed in order to cover surfaces with these noble metals as electroless plating catalysts (Japanese Patent Publication Nos. S59-52701, S60-181294, S61-194183, and H3-44149).

With some of the methods featuring the above-mentioned silane-coupling agents, however, the material of the object to be plated makes it difficult to obtain a strongly adhered and uniform deposit when the plating catalyst fixative and the plating catalyst are treated separately, that is, the noble metal ions serving as catalysts are deposited after the coupling agent has been adsorbed on the object. This is attributed to the fact that the coupling agent modifies the surface of the object or that the noble metal ions cannot be deposited with adequate efficiency. For similar reasons or because palladium exhibits inadequate catalytic activity, it is sometimes impossible to achieve uniform plating for some types of materials of the object to be plated or plating conditions in methods featuring mixed solutions of amino silane-coupling agents and palladium chloride. In particular, it is difficult to fix noble metal ions (catalyst) to semiconductor specular surfaces such as semiconductor substrates by employing conventional $SnCl_2$-based treatment in order to form electroless deposits on these surfaces. Another catalytic solution by conventional technique is known (U.S. Pat. No. 4,986,848). The catalytic solution aims to prevent from hollowing phenomenon in printed circuit board layers. However, the solution essentially includes particular amine compounds, which is not need in the present invention. The catalytic solution also may include a silane coupling agent. When a silane coupling agent is used, the solution needs much excess palladium compound comparing to the amount of the silane coupling agent, that is costly undesirable.

Conventionally, aluminum has mainly been used as a wiring material in semiconductor wafer processing. Because of an increase in wiring integration, highly electrically conductive copper has recently replaced aluminum to prevent an increase in signal delay time. The damascene method is used to form copper wiring, and commonly in this process, a wiring pattern is formed on a silicon wafer, a barrier layer and a seed layer are then deposited by sputtering or CVD, a wiring pattern is embedded by electroplating, and excess precipitated copper is removed with CMP.

When LSI wiring is formed on the surface of a silicon or other semiconductor wafer, vias or trenches are formed for embedding copper wiring, and a barrier metal selected from titanium, tantalum, tungsten, nitrides thereof, and the like is deposited by sputtering, CVD, or the like to a thickness of about 0.01–0.1 μm in order to prevent copper from diffusing in the silicon on the surface of the wafer. Conventionally, this barrier metal layer is covered with a thin copper layer (a seed layer) by sputtering, CVD, or the like in the same manner as described above. A barrier metal, which generally exhibits high electrical resistance, is copper with low electrical resistance which is provided (thinly deposited) in advance, in order to avoid a considerable difference in current density produced between the center portion and the periphery of the contacts on the perimeter of the wafer in the subsequently electroplated copper.

As increasingly narrower LSI wiring patterns are designed and vias and trenches become correspondingly narrower, the above-described conventionally performed sputtering methods fail to provide adequate coverage for the seed layer on the inside walls of the vias and trenches, creating defects (voids and seams) during subsequent electroplating. Although coverage is improved with CVD, the very high cost is a problem.

SUMMARY OF THE INVENTION

In view of the above situation, an object of the present invention is to provide a novel metal plating method capable of yielding adequate electroless plating for powders, specular bodies, and resin fabrics, which are products that are difficult to coat by conventional electroless plating. Another object of the present invention is to provide a metal plating method capable of yielding adequate electroless plating for specular bodies, particularly semiconductor wafers such as silicon wafers, and capable of solving the problem of inadequate coverage of the seed layer on the inside walls of vias and trenches, which is problematic when fine wiring is formed on the semiconductor wafer.

As a result of thoroughgoing research, the inventors perfected the present invention upon discovering that the stated objects, which are obtained by treating the surface of the object to be plated with a solution obtained by mixing or reacting in advance a silane-coupling agent capable of capturing metals, can solve the above-mentioned technical problems.

Specifically, the present invention provides the following.

(1) A metal plating method comprising:

preparing an acidic pretreatment agent by reacting or mixing in advance a noble metal compound with a silane-coupling agent whose functional groups are capable of capturing metals;

treating the surface of an object to be plated with said pretreatment agent; and then electroless plating said object.

(2) The metal plating method according to (1), wherein the object is a semiconductor wafer.

(3) The metal plating method according to (2) above, wherein the electroless plating is a copper or nickel electroless plating.

(4) The metal plating method according to (3) above, wherein a conductive layer is formed by said copper or nickel electroless plating, and a copper is electroplated on the conductive layer.

(5) A metal plating pretreatment agent comprising a solution obtained by reacting or mixing in advance a noble metal compound with a silane-coupling agent whose functional groups are capable of capturing metals.

(7) A semiconductor wafer, whereon a metal plating layer formed with the metal plating method according to any one of (1) to (4) above.

(8) A semiconductor device using the semiconductor wafer according to (6) above.

The present invention is characterized in that electroless plating is performed after the surface of an object to be plated is treated with a specific silane-coupling agent having the following functions in the same molecule: a function for capturing noble metal ions serving as an electroless plating catalyst, and a function for fixing these noble metal ions to the object. Not only the plating process can be shortened by using such a silane-coupling agent, but a catalyst can also be reliably fixed to the object. Furthermore, it was difficult in the past to fix the noble metal ions serving as a catalyst to a semiconductive specular body such as the wafer described above, but the present invention allows the catalyst to be reliably fixed to the semiconductor wafer by using the treatment agent in which functions for capturing the catalyst and fixing it to the semiconductor wafer are present in the same molecule. That is, the electron state and orientation needed to activate the plating catalyst in an efficient manner can be obtained because the functional groups capable of capturing metals are present in the molecular arrangement. And, good metal adhesion to semiconductor wafers and other heretofore difficult-to-process object can be achieved with the aid of the silane-coupling agent.

Imidazole groups are preferably used as the functional groups capable of capturing metals in accordance with the present invention.

Examples of suitable azole groups include imidazole, oxazole, thiazole, selenazole, pyrazole, isoxazole, isothiazole, triazole, oxadiazole, thiadiazole, tetrazole, oxatriazole, thiatriazole, bendazole, indazole, benzimidazole and benzotriazole. Among these, imidazole in particular is preferable. The adhesiveness of the plating to the object is extremely low despite adequate uniform plating when the pretreatment is performed using an imidazole that is not a silane-coupling agent though it is an azole compound.

The silane-coupling agent in the present invention is a compound having a $—SiX_1X_2X_3$ group, where $X_1$, $X_2$, and $X_3$ are alkyl groups, halogens, alkoxy groups, or any other functional groups capable of adhering to the object to be plated. $X_1$, $X_2$, and $X_3$ may be identical or different. A silane-coupling agent obtained by reacting an azole-based compound with an epoxysilane-based compound can be cited as an example (Japanese Patent Publication No. H6-256358). An epoxysilane-coupling agent shown by the formula:

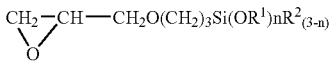

(where $R^1$ and $R^2$ are hydrogens or $C_1$–$C_3$ alkyl groups, and n is 1–3) should preferably be used as the silane compound containing epoxy groups for reacting with such an azole-based compound.

The reaction between an azole-based compound and the above-mentioned silane-based compound containing epoxy groups can be conducted under conditions as described in Japanese Patent Publication No. H6-256358. For example, 0.1–10 mol of the silane compound containing epoxy groups are dropped into 1 mol of an azole-based compound at 80–200° C. and allowed to react for 5 minutes to 2 hours. A solvent is not particularly required for this process, but organic solvents such as chloroform, dioxane, methanol and ethanol may be used.

Examples of suitable noble metal compounds include such compounds as chlorides, hydroxides, oxides, sulfates, ammonium salts and amine complexes of palladium, silver, platinum, gold and other metals exhibiting catalytic effects when copper, nickel, and the like are deposited on the surface of an object to be plated from an electroless plating solution. Palladium chloride is particularly preferred. The noble metal compounds are preferably used as aqueous solutions, and their concentration in the treatment solution is preferably 20–300 mg/L.

According to the metal plating method of the present invention, the object to be plated is not limited by the forms or properties thereof. For example, the present invention can be adapted to insulating objects such as inorganic materials (including glass, ceramic, and so on), plastic materials (including polyester, polyamide, polyimide, fluororesin, and so on), films and sheets made therefrom, and insulating boards made of epoxy resins and other materials reinforced with fibers, or optional glass fabric substrates; as well as objects to be plated with low conductivity such as silicone wafers and other semiconductors. The method in the present invention can be favorably applied to powders or specular bodies such as transparent glass plates, silicon wafers, and other semiconductor substrates. Such powders include, for example, glass beads, molybdenum disulfide powder, magnesium oxide powder, graphite powder, silicon carbide powder, zirconium oxide powder, alumina powder, silicon oxide powder, mica flakes, glass fiber, silicon nitride, and Teflon® powder.

As used herein, the term "semiconductor wafer" refers, in addition to silicon-based wafers, to wafers based on compound semiconductors such as gallium/arsenic, gallium/phosphorus, and indium/phosphorus. The metal plating method of the present invention does not impose any restrictions on the material constituting the plating surface material of the semiconductor wafer. For example, when LSI wiring is formed, the plating surface is a low-conductivity barrier metal selected from titanium, tantalum, tungsten and nitrides thereof, and other materials commonly deposited by vapor deposition, sputtering, CVD, or the like. The method of the present invention can be favorably applied in any of these cases. Furthermore, the present invention can be favorably applied when the plating surface is silicon or an oxide film thereof.

In the metal plating method of the present invention, noble metal ions and a silane-coupling agent whose functional groups are capable of capturing metals are mixed or reacted with each other in advance, yielding a pretreatment agent for treating a substrate for electroless plating. The pretreatment agent can be dissolved in an appropriate solvent when the surface of the object to be plated is treated with this pretreatment agent. Examples of suitable solvents include water, methyl alcohol, ethyl alcohol, 2-propanol, acetone, toluene, ethylene glycol, polyethylene glycol, dimethyl formamide, dimethyl sulfoxide, dioxane, and mixtures thereof. When water is used, the pH of the solution needs to be optimized in particular according to the object to be plated and plating conditions. The dissolved pretreatment agent generally exhibits acidity and the pH 2.0 to 4.0 is particularly preferable.

No limitations are imposed on the concentration of the silane-coupling agent which has functional groups capable of capturing metals, in the pretreatment agent or a solution of this pretreatment agent at applying to the surface, but a concentration of 0.001–10 wt % is preferred. The quantity of the compound deposited on the surface of the substrate tends to decrease and the desired effects are more difficult to obtain when the concentration is less than 0.001 wt %. When the concentration exceeds 10 wt %, too much of the compound is deposited, impeding drying and making the powder more likely to coagulate.

Dipping, brushing and other techniques, followed by solvent-vaporization, are commonly used to treat the surface of a cloth-like or plate-like substrate, but these are not the only options, and any method is acceptable as long a the silane-coupling agent is allowed to uniformly bond to the surface. In a method used for powders, the solvent is volatized following dipping, and the silane-coupling agent contained in the solvent is caused to adhere to the substrate surface. It is also possible to use a method in which the solvent is separated by filtration following treatment, and the moistened powder is dried. Because, adsorption on the substrate surface can be achieved in an immersed state due to the uniform film-forming properties of the silane-coupling agent. The drying process described below may be omitted in some cases, depending on the adsorbing conditions, and the process may be completed by rinsing only. Furthermore, room temperature is adequate for the pretreatment (surface treatment) temperature, but heating may be effective in certain cases depending on the object to be plated.

Before being pretreated for plating, the object to be plated may be washed. A conventional etching process by chromic acid or the like may performed if adhesive strength is required in particular.

To volatilize the solvent used following the surface treatment, it is sufficient to dry the surface by heating this solvent to the volatilization temperature thereof, but further heating is preferably conducted at 60–120° C. for 3–60 minutes. When water is used as the solvent, the drying process can be omitted and plating can be conducted solely by rinsing following the treatment. However, thorough rinsing is required in this case to prevent the catalysts from being carried into the plating solution.

In the plating method of the present invention, electroless plating follows the surface treatment described above. At this stage, metals such as copper, nickel, cobalt, tin and gold may be plated in accordance with this invention. It may be effective in such cases to treat the object with a solvent containing a reducing agent before plating. In the particular case of copper plating, a treatment with dimethylamine borane solution as a reducing agent may be performed. After a thin metal film is formed by electroless plating and the nonconductive substrate is provided with a certain degree of conductivity, it is possible to perform electroplating or displacement plating involving the use of a less noble metal.

When the metal plating method of the present invention is applied to a semiconductor wafer, a conventional seed layer depositing method is replaced with a method in which a catalyst is provided to a barrier metal by treating the surface as described above, and a seed layer is then formed by the electroless plating of copper or nickel. According to this method, the insufficient coverage of the inside walls of the vias and trenches of fine wiring can be solved at a lower cost than when CVD is employed. When copper is deposited by electroless plating, not only the seed layer, but also the embedded wiring can be continuously formed by the same electroless plating process. When the catalyst is uniformly deposited on the plating surface, seams tend to result when fine wiring is formed because the film grows evenly on the plating surface. However, the catalyst tends to adhere better to the inside walls of the fine wiring when deposited according the present invention. Because metal has a tendency to precipitate in areas in which more catalyst is deposited, the result is a bottom-up precipitation process similar to the one occurring with the copper electroplating solution used for embedding fine wiring, and fine wiring can be embedded without the formation of seams. Of course, it is possible to embed wiring by copper electroplating after forming a seed layer by electroless copper plating.

When the metal plating method according to the present invention is used on a semiconductor wafer, it is common practice to employ a method in which the solvent is volatilized after the wafer surface is treated by dipping. This is not the only option, however, and any method is acceptable as long a silane-coupling agent is allowed to uniformly bond to the surface. Room temperature is sufficient for treating the surface, but heating allows the catalyst to be deposited at a higher rate and in a greater amount. A heating temperature of 30–80° C. is adequate. A solution obtained by dissolving a pretreatment agent in an appropriate solvent in the above-described manner may be used for the surface treatment. Depending on the bonding conditions, the drying step can be dispensed with and rinsing alone can be performed.

To volatilize the spent solvent after the wafer surface has been treated, it is sufficient to dry the surface by raising the temperature above the solvent volatilization temperature, and preferably further keeping the system at 60–120° C. for 3–6 minutes. When water is used as the solvent, the drying process can be omitted and plating can be conducted by merely performing rinsing after the treatment. However, thorough rinsing is required in this case to prevent the catalysts from being carried into the plating solution.

Formalin is commonly contained in the electroless copper plating solution as a reducing agent. In recent years, however, the use of formalin has been gradually phased out because of problems associated with the environmental impact. This problem can be addressed by the use of electroless nickel plating solutions. With electroless nickel plating, electric resistance increases because the film commonly contains several percent of phosphorus or borane. It is therefore necessary to provide the minimum film thickness still capable of providing electrical conductivity when the seed layer is formed by electroless nickel plating.

Alkali components are commonly contained as raw materials in electroless copper plating and nickel plating solutions. Raw materials devoid of alkalis must be used because alkali components are the most harmful impurities of wiring materials. For example, tetramethylammonium hydroxide may be used in place of sodium hydroxide, which is designed to balance the pH. Also, dimethylamine borane may be used as the reducing agent of an electroless nickel plating solution.

DETAILED DESCRIPTION OF THE PREFERRED EMBODIMENTS

Figure 1:
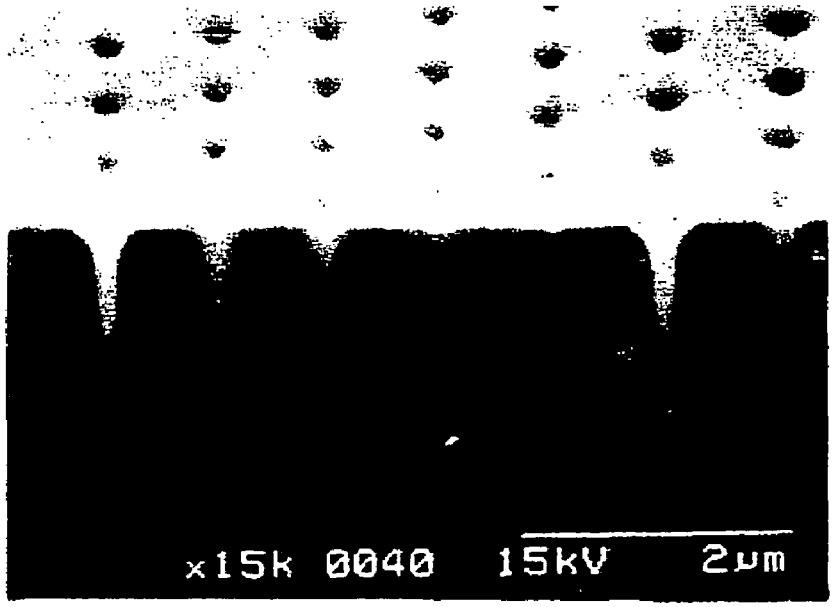
FIG. 1 is an SEM photographic image of a copper plating film formed on a silicon wafer in Example 5.

Examples of the present invention are described in detail below. Examples 1–4 and Comparative Examples 1–5 describe plating on a cloth-like object using the metal plating method of the present invention. Examples 5–8 and Comparative Examples 6–7 describe plating on a semiconductor wafer using the metal plating method of the present invention.

EXAMPLE 1

An equimolar reaction was first conducted between imidazole and γ-glycidoxypropyltrimethoxysilane, yielding a silane-coupling agent as the product. A palladium chloride aqueous solution was subsequently added at room temperature to an aqueous solution containing 0.2 wt % of this silane-coupling agent to achieve the palladium chloride concentration of 150 mg/L, thereby, a pretreatment plating agent was prepared. The pH of this pretreatment agent was 2.9. Polyester resin in the form of a cloth was immersed in the pretreatment plating agent for 3 minutes at room temperature, and the polyester cloth was then thoroughly rinsed in running water. The polyester cloth was then plated at 70° C. for 5 minutes with the use of an electroless nickel plating solution (nickel plating solution FM-0 manufactured by Nikko Metal Plating). As a result, the polyester cloth was provided with a nickel plating that had adequate adhesive strength and uniformity across the entire surface.

EXAMPLE 2

Nylon cloth was immersed for 3 minutes at room temperature in the pretreatment plating agent prepared in Example 1, and thoroughly rinsed in running water. The nylon cloth was then plated at 70° C. for 5 minutes with the use of an electroless nickel plating solution (nickel plating solution FM-0 manufactured by Nikko Metal Plating). As a result, the nylon cloth was provided with a nickel plating that had adequate adhesive strength and uniformity across the entire surface.

EXAMPLE 3

A palladium chloride aqueous solution was added at room temperature to an aqueous solution containing 0.05 wt % of the silane-coupling agent prepared in Example 1 to achieve the palladium chloride concentration of 80 mg/L, thereby, a pretreatment plating agent was prepared. Polyester cloth was immersed in the pretreatment plating agent for 3 minutes at room temperature, and the polyester cloth was then thoroughly rinsed in running water. The polyester cloth was then plated at 70° C. for 5 minutes with the use of an electroless nickel plating solution (nickel plating solution FM-0 manufactured by Nikko Metal Plating). As a result, the polyester cloth was provided with a nickel plating that had adequate adhesive strength and uniformity across the entire surface.

EXAMPLE 4

Polyester resin in the form of a cloth was immersed for 3 minutes at room temperature in the pretreatment plating agent prepared in Example 1, and was then thoroughly rinsed in running water. The polyester cloth was subsequently immersed for 3 minutes in a dimethylamine borane (3.7 g/L) aqueous solution heated to 60° C. The polyester cloth was then plated at 70° C. for 10 minutes with the use of an electroless copper plating solution (copper plating solution PM-0 manufactured by Nikko Metal Plating). As a result, the polyester cloth was provided with a copper plating that had adequate adhesive strength and uniformity across the entire surface.

COMPARATIVE EXAMPLE 1

A silane-coupling agent was obtained in the same manner as in Example 1. A polyester resin in the form of a cloth was immersed for 3 minutes at room temperature in an aqueous solution containing 0.2 wt % of the silane-coupling agent alone. The polyester resin was subsequently immersed for 3 minutes at room temperature in an aqueous solution containing 30 mg/L of palladium chloride and then thoroughly rinsed in running water. The polyester cloth was then plated at 70° C. for 5 minutes with the use of an electroless nickel plating solution (nickel plating solution FM-0 manufactured by Nikko Metal Plating). As a result, the polyester cloth remained mostly devoid of nickel plating.

COMPARATIVE EXAMPLE 2

Other than using a nylon cloth in place of the polyester resin in the form of a cloth in Comparative Example 1, nickel plating was conducted in the same manner as in Comparative Example 1. As a result, the nylon cloth remained mostly devoid of nickel plating.

COMPARATIVE EXAMPLE 3

A polyester resin in the form of a cloth was immersed for 3 minutes at room temperature in an aqueous solution containing solely 0.2 wt % of a silane-coupling agent obtained in the same manner as in Example 1. The polyester resin was subsequently immersed in an aqueous solution containing 30 mg/L of palladium chloride for 3 minutes at room temperature and then thoroughly rinsed in running water. The polyester cloth was subsequently immersed for 3 minutes in a dimethylamine borane (3.7 g/L) aqueous solution heated to 60° C., and the polyester cloth was then plated at 70° C. for 10 minutes with the use of an electroless copper plating solution (nickel plating solution PM-0 manufactured by Nikko Metal Plating). As a result, the polyester resin cloth remained mostly devoid of copper plating.

COMPARATIVE EXAMPLE 4

Polyester cloth was plated in the same manner as in Example 1 except that γ-aminopropyltriethoxysilane (manufactured by Kanto Kagaku) was used instead of the silane-coupling agent used in Example 1, which was equimolar reaction product of imidazole and γ-glycidoxypropyltrimethoxysilane. As a result, the polyester resin cloth remained mostly devoid of nickel plating.

COMPARATIVE EXAMPLE 5

Polyester cloth was plated with nickel by electroless plating using the same operations as Example 1 except that imidazole was employed instead of the equimolar reaction product of imidazole and γ-glycidoxypropyltrimethoxysilane used in Example 1 and that the concentration of palladium chloride was increased to 300 mg/L. As a result, the polyester cloth had adequate coverage but inferior adhesive strength.

EXAMPLE 5

Silicon wafers provided with minute via patterns and sputtered with 30 nm of TaN were used as objects to be plated in the Examples 5–8 and Comparative Examples 6–7 described below. The via patterns had a depth of 1 μm and a hole diameter of 0.18 μm.

A palladium chloride aqueous solution was added at room temperature to an aqueous solution containing 0.05 wt % of a silane-coupling agent obtained in the same manner as in Example 1 to achieve the palladium chloride concentration of 150 mg/L, thereby, a pretreatment plating agent was prepared. The above-mentioned silicon wafer was immersed in this pretreatment plating agent solution for 10 minutes at 60° C. and then thoroughly rinsed in running water. This silicon wafer was immersed for 15 minutes in 10 g/L of dimethylamine borane aqueous solution heated to 60° C., and was then thoroughly rinsed in running water. This silicon wafer was then plated at 60° C. for 1 minute with the use of an electroless copper plating solution (copper plating solution NKM-554 manufactured by Nikko Metal Plating). As a result, the copper was plated with adequate adhesiveness across the entire surface of the silicon wafer. An SEM observation of cleaved cross sections for the embedding properties of fine via patterns revealed that no voids or seams had formed and that adequate embedding properties were achieved, as shown in FIG. 1.

EXAMPLE 6

A palladium chloride aqueous solution was added at room temperature to an aqueous solution containing 0.05 wt % of the silane-coupling agent obtained in the same manner as in Example 1 to achieve the palladium chloride concentration of 200 mg/L, thereby, a pretreatment plating agent was prepared. The above-mentioned silicon wafer was immersed in this pretreatment plating agent for 5 minutes at 60° C. and then thoroughly rinsed in running water. This silicon wafer was then plated at 65° C. for 4 seconds with the use of an electroless nickel plating solution (nickel plating solution Ni—B manufactured by Nikko Metal Plating) and then thoroughly rinsed in running water. The silicon wafer was then plated at 60° C. for 1 minute with the use of an electroless copper plating solution (copper plating solution NKM-554 manufactured by Nikko Metal Plating). As a result, the copper was plated with adequate adhesiveness across the entire surface of the silicon wafer. A SEM observation of cleaved cross sections for the embedding properties of fine via patterns revealed that no voids or seams had formed and that adequate embedding properties were achieved.

EXAMPLE 7

A palladium chloride aqueous solution was added at room temperature to an aqueous solution containing 0.1 wt % of the silane-coupling agent obtained in the same manner as in Example 1 to achieve the palladium chloride concentration of 150 mg/L, thereby, a pretreatment plating agent was prepared. The above-mentioned silicon wafer was immersed in this pretreatment plating agent for 10 minutes at 60° C. and then thoroughly rinsed in running water. The silicon wafer was subsequently immersed for 15 minutes in 10 g/L of dimethylamine borane aqueous solution heated to 60° C., and was then thoroughly rinsed in running water. This silicon wafer was then plated at 60° C. for 30 seconds with the use of an electroless copper plating solution (copper plating solution NKM-554 manufactured by Nikko Metal Plating). As an additional step, this silicon wafer was plated to a thickness equivalent of 1 μm at room temperature with the use of a copper electroplating solution (copper 20 g/L, sulfuric acid 200 g/L, chlorine 70 mg/L, polyethylene glycol (molecular weight 15,000) 13 μmol/L, bis(3-sulfopropyl) disodium disulfide 20 μmol/L) at a cathode electric current density of 1 A/dm$^2$. As a result, the copper was plated with adequate adhesiveness across the entire surface of the silicon wafer. A SEM observation of cleaved cross sections for the embedding properties of fine via patterns revealed that no voids or seams had formed and that adequate embedding properties were achieved.

EXAMPLE 8

A palladium chloride aqueous solution was added at room temperature to an aqueous solution contain 0.05 wt % of the same silane-coupling agent as in Example 1 to achieve the palladium chloride concentration of 100 mg/L, thereby, a pretreatment plating agent was prepared. The above-mentioned silicon wafer was immersed in this pretreatment agent for 5 minutes at 60° C. and then thoroughly rinsed in running water. The silicon wafer was subsequently plated for 4 seconds at 65° C. with the use of an electroless nickel plating solution (nickel plating solution Ni—B manufactured by Nikko Metal Plating) and then thoroughly rinsed in running water. As an additional step, an equivalent of 1 μm of plating was applied onto this silicon wafer at room temperature with the use of a copper electroplating solution (copper 16 g/L, sulfuric acid 240 g/L, chlorine 50 mg/L, polyethylene glycol (molecular weight 3,350) 90 μmol/L, sodium 3-mercapto-1-propane sulfonate 40 μmol/L) at a cathode electric current density of 1 A/dm$^2$. As a result, the copper was plated with adequate adhesiveness across the entire surface of the silicon wafer. A SEM observation of cleaved cross sections for the embedding properties of fine via patterns revealed that no voids or seams had formed and that adequate embedding properties were achieved.

COMPARATIVE EXAMPLE 6

Figure 2:
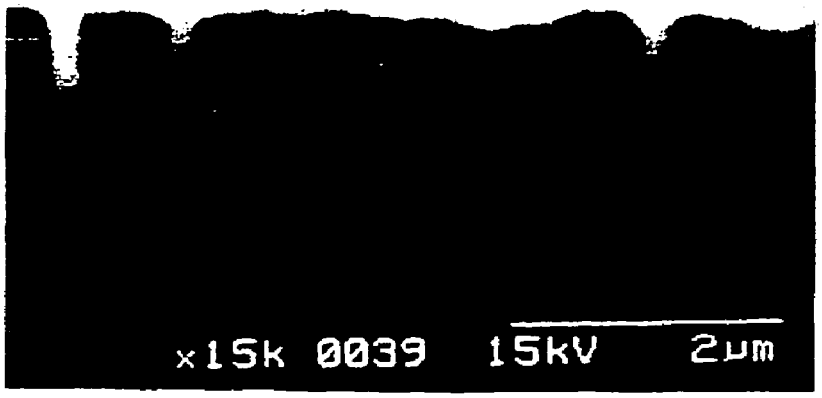
FIG. 2 is an SEM photographic image of a copper plating film formed on a silicon wafer in Comparative Example 6.

Copper was further sputtered to a thickness of 100 nm on the above-mentioned silicon wafer. This silicon wafer was plated to a thickness equivalent of 1 μm at room temperature with the use of a copper electroplating solution (copper 20 g/L, sulfuric acid 200 g/L, chlorine 70 mg/L, polyethylene glycol (molecular weight 15,000) 13 μmol/L, bis(3-sulfopropyl)disodium disulfide 20 μmol/L) at a cathode electric current density 1 A/dm$^2$. As a result, the copper was plated with adequate adhesiveness on the silicon wafer. A SEM observation of cleaved cross sections for the embedding properties of fine via patterns revealed the absence of voids, as shown in FIG. 2.

COMPARATIVE EXAMPLE 7

The above-mentioned silicon wafer was treated with a hydrochloric aqueous solution of $SnCl_2$, immersed in an aqueous solution of $PdCl_2$, and thoroughly rinsed in running water. This silicon wafer was subsequently plated at 60° C. for 1 minute with the use of an electroless copper plating solution (copper plating solution NKM-554 manufactured by Nikko Metal Plating). As a result, the silicon wafer remained mostly devoid of copper plating.

As described above, the novel method of the present invention allows electroless plating to be applied in a simple process to materials such as powders and resin cloth, which were thought to be impossible to be plated with conventional plating method. Another feature of the plating method of the present invention is that noble metal ions serving as a catalyst can be fixed to semiconductive specular bodies such as semiconductor wafers, which were conventionally difficult to be bonded with such catalyst, and electroless plating can be easily conducted. It is also possible to overcome problems associated with the insufficient coverage of the seed layer on the inside walls of vias and trenches during the formation of fine LSI wiring.

What is claimed is:

1. A metal plating method comprising:

preparing pretreatment agent consisting essentially of a palladium compound reacted or mixed with a silane-coupling agent obtained by reacting an imidazole-based compound and an epoxysilane-based compound;

treating the surface of an object to be plated with said pretreatment agent; and then electroless plating said plating object.

2. The metal plating method according to claim 1, wherein said object is a semiconductor wafer.

3. The metal plating method according to claim 1, wherein said electroless plating is a copper or nickel electroless plating.

4. The metal plating method according to claim 3, wherein a conductive layer is formed by said copper or nickel electroless plating, and a copper is electroplated on said conductive layer.

5. A semiconductor wafer, whereon a metal plating layer been formed with the metal plating method according to claim 1.

6. A semiconductor device using the semiconductor wafer according to claim 5.

7. The metal plating method of claim 1, wherein the pretreatment agent consists of the palladium compound reacted or mixed with the silane-coupling agent.

8. The metal plating method of claim 1, wherein the palladium compound is palladium chloride, the imidazole-based compound is imidazole and the epoxysilane-based compound is γ-glycidoxypropyltrimethoxysilane.

9. A metal plating pretreatment agent consisting essentially of a solution obtained by reacting or mixing in advance a palladium compound with a silane-coupling agent obtained by reacting an imidazole-based compound and an epoxysilane-based compound.

10. The metal plating pretreatment agent of claim 9, consisting of the palladium compound reacted or mixed with the silane-coupling agent.

11. The metal plating pretreatment agent of claim 9, wherein the palladium compound is palladium chloride, the imidazole-based compound is imidazole and the epoxysilane-based compound is γ-glycidoxypropyltrimethoxysilane.

* * * * *